United States Patent [19]

Niedermeyer

[11] 4,215,975

[45] Aug. 5, 1980

[54] SUMP PUMP WITH AIR COLUMN THEREIN WHEN PUMP IS NOT OPERATING

[76] Inventor: Karl O. Niedermeyer, 17W068 North St., Bensenville, Ill. 60106

[21] Appl. No.: 969,065

[22] Filed: Dec. 13, 1978

[51] Int. Cl.[2] ..... F04B 49/06; F04B 49/00

[52] U.S. Cl. ..... 417/53; 417/40; 417/211.5; 417/2

[58] Field of Search ..... 417/2, 40, 211.5, 53

[56] References Cited

U.S. PATENT DOCUMENTS

| | | | |
|---|---|---|---|
| 2,810,350 | 10/1957 | MacWilliams | 417/40 |
| 3,972,647 | 8/1976 | Niedermeyer | 417/40 |
| 4,080,104 | 3/1978 | Brown | 417/40 |
| 4,171,186 | 10/1979 | Chapman | 417/40 |

*Primary Examiner*—William L. Freeh

*Attorney, Agent, or Firm*—Darbo & Vandenburgh

[57] ABSTRACT

An air column is employed in a sump pump to exclude liquid and foreign matter therein from the pump interior until a time just prior to priming and pumping. Just prior to the pump being turned on the air column is vented, thus permitting the liquid to rise to a level in the pump commensurate with the level elsewhere in the sump and thereby priming the pump.

5 Claims, 2 Drawing Figures

SUMP PUMP WITH AIR COLUMN THEREIN WHEN PUMP IS NOT OPERATING

BACKGROUND AND SUMMARY OF THE INVENTION

The present invention primarily relates to backup, or secondary, sump pumps which are battery powered and used in the event of an emergency caused by a failure of a primary sump pump to evacuate the water from the sump. For example, a primary sump pump normally will be powered from the electric line and, perhaps due to the failure of power in the electric lines during a storm, that primary pump will not be operative. The battery powered pump at that time then takes over the task of removing water from the sump. Obviously, such backup pumps operate only infrequently. Yet, they will in many instances be in the sump where they are alternately submerged in water and then free of water, as the water level in the sump goes up and down as a result of the action of the primary pump. This constant bathing of the pump components and then exposing them to air can be particularly hard on the pump components and the mechanical operating condition of the pump, particularly when the pump is normally standing idle. Furthermore, the water moving into and out of the backup sump pump is likely to carry with it contaminates which are deposited on and in that pump further impairing its operating condition.

The principal object of the present invention is to provide a standby pump apparatus such that the water, and any contaminates that it may carry, will be excluded from the operating components of the pump during its period of inaction. Thus there is less opportunity for those operating components to be so deleteriously affected that the pump will fail to operate when it is vitally needed. Just prior to the pump being used, the air column is dissipated and the pump primed.

It is not uncommon for sump pumps to employ a check valve immediately above (or downstream of) the pump. The purpose of this check valve is to prevent the water in the discharge line from draining back into the sump when the pump shuts down. However, in such installations the water below the check valve will not drain out to a significant extent when the pump shuts down. Such a check valve is employed in the present invention, but an air bleeder line is connected below the check valve so that air may be admitted to permit the water below the check valve to be drained out. When the bleeder line is thereafter closed, an air column is then established through the pump. This air column then acts like a diving bell to prevent water from thereafter backing up into the pump to a significant extent. In the present invention this bleeder line is opened just prior to the pump being operated. This permits the air to be expelled and the water to rise in the pump to the level of that in the remainder of the sump. When the pump commences to operate the bleeder line is closed by the valve. This avoids loss of efficiency of the pump.

It is known (U.S. Pat. No. 3,246,606) to use a bleeder line to dissipate an air column and permit the priming of an upper pump, of a dual pump unit, when the unit turns on. But that really has no relation to the present invention wherein the bleeder line is controlled.

DESCRIPTION OF SPECIFIC EMBODIMENT

Figure 1:
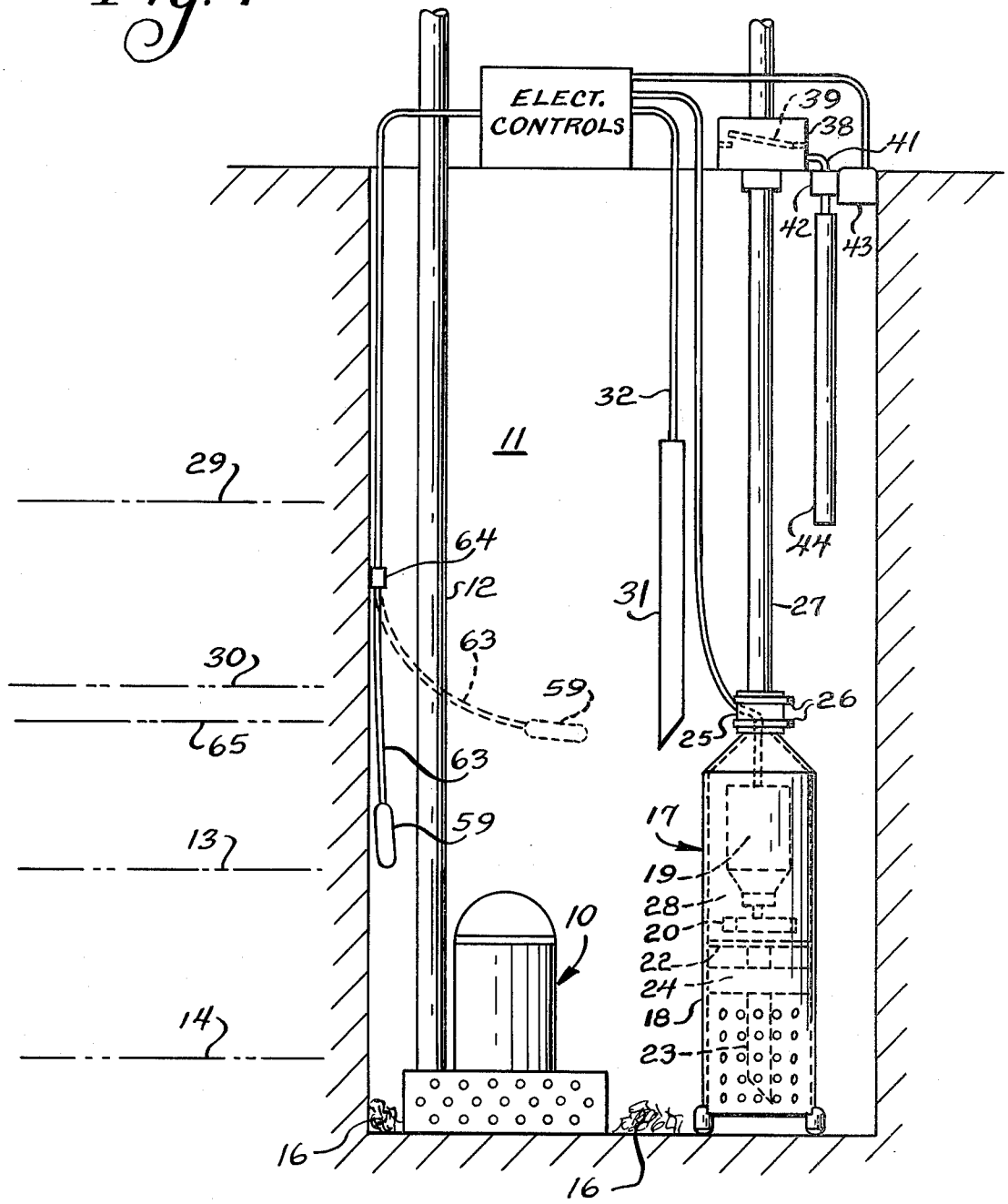
FIG. 1 is an elevational view showing a primary sump pump and a secondary or backup sump pump located in a sump, which is in section.

The following disclosure is offered for public dissemination in return for the grant of a patent. Although it is detailed to ensure adequacy and aid understanding, this is not intended to prejudice that purpose of a patent which is to cover each new inventive concept therein no matter how others may later disguise it by variations in form or additions or further improvements.

A conventional sump pump, generally 10, is employed in a sump 11 to remove liquid, e.g., water, which may collect therein. For example, the basements of homes or commercial establishments may have such sumps to collect water for removal and thereby keep the basement dry. A discharge pipe 12 is connected to the pump so that the water to be removed can be conducted to an appropriate location for discharge: Such a pump has controls (not shown) so that, for example, the pump is energized when the level of the water in the sump reaches that indicated by line 13 and the pump is turned off after it has extracted sufficient liquid from the sump to lower the liquid level to line 14.

Such primary pumps are subject to failure. For example, they are powered by the alternating current employed for electrical power elsewhere in the building. Thus when a power failure occurs the pump becomes inoperative. Since it is not uncommon for such a power failure to occur as a result of a storm, the pump may become inoperative just at the very time it is needed most. Other factors that may result in the pump becoming inoperative are: corrosion of pump parts; and clogging of the pump, or pump screen, as a result of debris accumulating in the sump; etc.

As a result of the fact that the primary sump pump 10 may occasionally fail to operate. many users of sump pumps will also employ a secondary or backup sump pump unit, generally 17. The pump unit illustrated includes a housing or shell 18 within which is a battery powered electric motor 19 whose shaft is connected to the impeller or pump 20. The intake for the pump is through a central opening in a plate 22, which opening communicates with a drawtube 23 held in an annular mount 24. The bottom of shell 18 is perforated to serve as a screen. The upper end of the shell is connected by means of a flexible hose 25 and hose clamps 26 to a discharge conduit 27. The pump unit has a passageway 28 extending from the sump to the conduit 27, which passageway consists of the interior of the drawtube and the interior of the housing 18 about such interior parts as motor 19, etc. The arrangement is such that when the motor 19 is energized the pump 20 draws liquid out of the sump through passageway 28 and discharges it out through conduit 27. Further details of such a pump are illustrated and described in my pending application Ser. No. 793,402, filed May 3, 1977, and entitled Through Flow Sump Pump, (now Pat. No. 4,177,021) the disclosure of which is incorporated herein by reference.

Such a secondary pump is not intended to operate all the time, but only in the event that the primary pump 10 fails to keep the liquid level in the sump down to the lower part thereof. Thus, for example, the controls for the secondary pump unit 17 will be set so that the pump unit will turn on when the liquid level in the sump reaches that indicated by line 29 and will turn the pump unit off when the liquid level drops to that indicated by line 30.

One such control for providing a differential in liquid level between the point at which the motor 19 turns on and turns off is described in my copending application Ser. No. 891,213, filed Mar. 29, 1978, (now abandoned) and entitled Air Pressure Switch Signaling Two Different Pressure Conditions, the disclosure of which is incorporated herein by reference. It comprises a bell 31 which is suspended with its open end down and which communicates through a hose or tube 32 with a fluid pressure actuator 33 (FIG. 2) having a diaphragm 34 operatively connected to an electrical switch 35. As the water rises above the bottom, open end of the bell 31, air pressure builds up in the bell which pressure is transmitted through the hose to the actuator to move the diaphragm. At one air pressure condition (corresponding to level 29) switch 35 is closed, and at a second air pressure condition (corresponding to level 30) the switch 35 again is open. The same differential water level/switch actuation can be achieved with float switches, as for example that described in my U.S. Pat. No. 4,086,457, issued Apr. 25, 1978, the disclosure of which is incorporated herein by reference.

With an arrangement as thus far described, it will be noted that as the liquid level in the sump varies between the liquid level limits defined by lines 13 and 14 (resulting from the operation of the primary pump 10) the liquid will correspondingly go up and down within the pump 17. This repeated bathing of the parts within the secondary pump 17 and then exposing them to air as the water level rises and falls can have a deleterious effect upon the backup pump unit. Also, floating debris 16 may get past the screen thereof and work into the pump where it can have a deleterious effect. Obviously, the backup pump unit 17 was put in the sump to provide protection in the event of an emergency and should the pump fail to operate when required, the putting of the backup pump in the sump has been futile. The purpose of the present invention is to provide additional protection to the backup pump 17 to provide additional assurance that it will operate when necessary. This is done by maintaining an air column in the pump, which air column will prevent the liquid in the sump from getting into the pump as the liquid level fluctuates below that indicated by line 13. However, just before the backup pump 17 is to turn on, the air column is dissipated by being bled off, thus permitting the liquid to rise up within the pump to a level corresponding to that elsewhere in the sump, thus priming the backup pump.

To this end a check valve 38 is inserted in discharge conduit 27 a short distance above the backup pump unit 17. Such a check valve has a flapper or valve closure 39 pivotally mounted over an opening. When the pump unit 18 is operating, the force of the water through conduit 27 will push flapper 39 open. When the pump unit 17 shuts off, the flapper, under the urging of gravity or a spring, again covers the opening to close off the discharge line. The flapper also is urged closed, and held in that position, by the weight of the water in that part of the discharge line above the check valve. The use of check valves in discharge lines from pumps is prior art.

If the conduit 27 below the check valve 38 and the passageway 28 through the pump unit 17 down to the bottom of the drawtube 23 is free of water, and with the check valve 38 held closed, the action is like that of a diving bell; i.e., as the water rises in the sump above the bottom of the drawtube 23, it pressurizes the air in passageway 28 but is able to rise only a very short distance above the bottom of drawtube 23. Thus the pump 20 remains in the air pocket and is not bathed by the liquid in the sump. However, the pump 20 should not run dry and should be primed when it is to operate. To this end the air column in the passageway 28 must be dissipated just prior, or in effect simultaneously with, the operation of the pump unit 17.

In the illustrated embodiment a conduit fitting 41 is threaded into the check valve to communicate with the interior thereof just below the flapper or valve closure 39. A commercially available, electrically operated valve unit, comprising a valve 42 and a valve operator in the form of solenoid 43, is connected to fitting 41. The valve is a normally closed valve and is opened when the solenoid 43 is energized. A hose 44 is connected to the other side of valve 42 and extends into sump 11.

Figure 2:
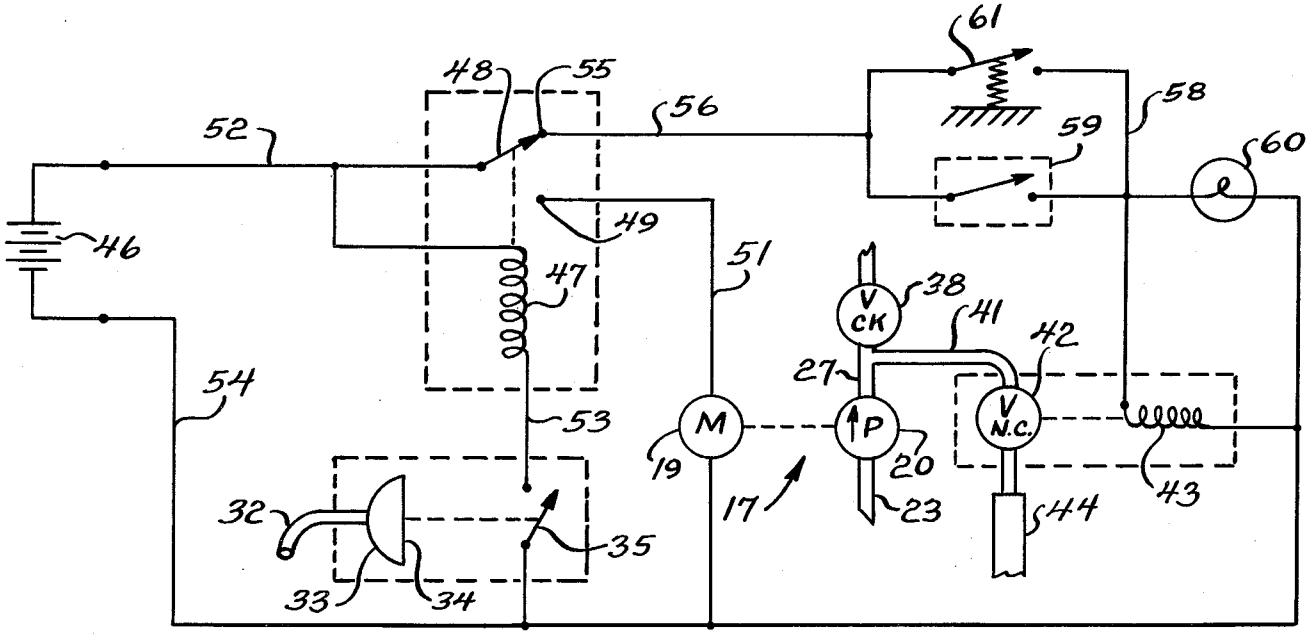
FIG. 2 is a schematic drawing showing the manner of use of the invention in connection with the secondary sump pump of FIG. 1.

Referring to FIG. 2, it is conventional to operate the motor 19 by a control device such as a relay controlled by switch 35 and thus energize the motor from a battery (e.g., 12 volt lead/acid battery) 46. Such a relay would comprise a solenoid 47 and a switch arm 48 which is moved to contact 49 when the solenoid is energized. Thus with contact 49 connected to motor 19 by wire 51, switch arm 48 and solenoid 47 connected to one side of battery 46 by wire 52, switch 35 connected to solenoid 47 by wire 53 and with wire 54 connecting the other side of the battery to switch 35 and motor 19, when the switch 35 closes switch arm 48 is moved to contact 49 to start motor 19. In the present invention, such control device is modified to replace the single-pole, single-throw relay switch (switch arm 48 and contact 49) by a relay having a single-pole, double-throw switch, i.e., having a second, normally closed contact 55. Thus with relay solenoid 47 deenergized, a wire 56 connected to contact 55 is energized.

Wire 56 as well as a wire 58 is connected to a float switch 59 serving as a water level sensor. Wire 58 also connects to one side of solenoid 43 for valve 42 and to a signal light 60. Wire 54 also connects to solenoid 43 and light 60. A momentary contact, push-botton operated switch 61, urged to the normally open position by a spring, is connected in parallel with float switch 59.

Float switches are commonly employed in the art and comprise a float within which is incorporated a mercury switch. As the float reaches about the horizontal position, the mercury flows therein to create an electrical circuit between a pair of contacts. Thus, referring to FIg. 1, the flexible support 63 for the float switch 59 is held by a mounting strap 64 in a manner such that when the liquid in the sump rises to the level indicated by line 65 the float switch 59 will have reached the point at which the electrical contacts close (the position of the float switch illustrated in dashed lines). When the liquid level is about at the bottom of the sump, the float switch hangs down to the position illustrated in solid lines. At that time the electrical circuit between the contacts thereof is, of course, open. The flexible support for the float switch may comprise a flexible plastic tube within which are the wires 56 and 58.

Assume that the primary pump 10 has failed to operate. When the liquid level reaches that indicated by line 65, the float switch closes. This completes the electrical circuit from the energized wire 56 to both the signal light 60 and the solenoid 43. The energizing of solenoid 43 opens normally closed valve 42. With valve 42 open, air can exhaust, be bled off, from below the flapper 39 of the check valve and thus the air column in passageway 28 is dissipated. The liquid now rises within the pump unit 17 to a level corresponding with that of line 65. As the liquid continues to rise in the sump and reaches the level indicated by line 29, the switch 35 is closed. This energizes solenoid 47 and moves switch arm 48 to contact 49. Wire 56 no longer is energized, resulting in the deenergizing of solenoid 43 and the closing of valve 42. Wire 51 and motor 19 are energized from contact 49 and switch arm 48; thus the pump unit 17 is operating to discharge liquid from the sump. When the liquid level in the sump drops to that indicated by line 30 the switch 35 again opens and relay solenoid 47 is deenergized. Switch arm 48 again returns to contact 55. This turns off the motor and again energizes wire 56. Float switch 59 remains closed so that solenoid 43 and light 60 are both energized. Light 60 is placed at a strategic location to be seen by the occupant of the building. Thus the occupant upon seeing the light is apprised of the fact that the primary pump 10 has failed to operate and that the secondary pump 17 has assumed the protective role of eliminating water from the sump. Presumably the occupant of the building will now take action to remedy the failure of the primary pump 10.

Assume that the primary pump 10 is put back into operation. It then will commence withdrawing liquid from the sump. As the liquid level drops below that indicated by line 65, the switch 59 opens. This deenergizes light 60 and solenoid 43, closing valve 42. After the primary pump 10 has operated sufficiently to drop the liquid level to that corresponding to line 14, the primary pump turns off. At this point, the occupant briefly closes switch 61. This energizes solenoid 43 to open valve 42. With valve 42 open air can pass into the check valve from hose 44. This permits the liquid in conduit 27 and passageway 28 to drain out of the drawtube 23. Switch 61 then is allowed to open, deenergizing solenoid 43 and closing valve 42. The air column in the passageway is thus again reestablished.

In FIG. 1 the secondary pump unit 17 has been illustrated in the position at the bottom of the sump since this is the most severe condition. Preferably it is suitable supported at a higher elevation in the sump, that is, at a level such that the bottom of the drawtube is above the level indicated by line 13, but with the pump 20 below the level indicated by line 29. It is necessary that the pump 20 be below the level indicated by the line 29 so that the pump will be primed at the instant that the pump motor 19 is turned on. An installer of sump pumps will find sumps of all shapes and sizes in the course of his work. The conditions, including sump size and configuration, will dictate just where the backup pump unit 17 is located in the sump. The same is true of the specific location for a particular installation of the water levels indicated by the various lines 13, 14, 65, 30 and 29. No conclusion should be drawn as to the spacing between these lines in FIG. 1, since FIG. 1 is merely illustrative and a worker in the art will know what adjustments to make for a particular location.

I claim:

1. An attachment for a sump pump apparatus, or the like, used in a liquid containing sump and comprising a pump unit having a liquid passageway therethrough through which liquid is pumped, said pump unit including a pump and a motor therefor, a liquid discharge conduit communicating with said passageway and extending upwardly therefrom, a check valve in said discharge line to permit liquid to flow in said line away from said pump unit and to prevent return flow from the line through the passageway, and an electrical control device for energizing the pump unit when the liquid level in the sump rises to a predetermined elevation which is above that of said pump and deenergizing the pump unit when the liquid level thereafter drops to a given elevation, said attachment comprising:

vent means communicating with said passageway below said check valve and above said pump for providing a vent through which fluid can flow from said passageway to a location exterior thereof;

valve means connected to said vent means for opening and closing said vent, said valve means being normally closed whereby with said check valve closed and an air column existing below said check valve and through said pump unit the liquid in the sump may rise to a level above the pump unit without significantly entering the pump unit; and control means connected to said valve means and including sensor means responsive to the level of the liquid in the sump for operating said valve means to open said vent by the time the liquid level rises to said predetermined elevation whereby the opening of the vent will permit the dissipation of the air column to an extent sufficient to allow the liquid level in the pump unit to equilibrate with that of the level elsewhere in the sump thus priming the pump.

2. An attachment as set forth in claim 1, wherein said valve means comprises a valve, an electrical solenoid valve operator, and said control means comprises an electrical switch actuated by said sensor means, and electrical circuit means interconnecting said switch and said solenoid valve operator.

3. An attachment as set forth in claim 2, wherein said solenoid valve operator opens said valve when energized, said switch is normally open and is closed by the sensor means detecting that the level of the liquid in the sump has risen to a level lower than said predetermined elevation, said electrical control device includes a double-throw switch means having two alternately energized contacts one of which is connected to the motor to energize the motor when that one contact is energized, and said circuit means connects the other of the contacts, said switch and said solenoid valve operator in series.

4. An attachment as set forth in claim 3, wherein said sensor means opens said vent at a time when said liquid level is still below said given elevation, and including a signal light connected in parallel with said solenoid valve operator.

5. A method of protecting the operating components of a sump pump apparatus, or the like, used in a liquid containing sump and comprising a pump unit having a liquid passageway therethrough through which liquid is pumped, said pump unit including a pump, a liquid discharge line communicating with said passageway and extending upwardly therefrom, said method comprising the steps of:

at the time said pump discontinues operation establishing an air column through said pump and extending sufficiently below said operating components that the liquid in the sump will not rise sufficiently in the pump unit to immerse said operating components no matter how high the liquid rises in said sump externally of the pump unit; and no later than the next starting of the pump unit, venting said air column to permit the liquid to rise in the pump unit to a level commensurate with the level of the liquid in the sump.

* * * * *